US006032990A

United States Patent [19]

Stone et al.

[11] Patent Number: 6,032,990

[45] Date of Patent: Mar. 7, 2000

[54] ADJUSTABLE LATCH FOR WINDOW ASSEMBLY

[75] Inventors: Ricky L. Stone, St. Joseph, Tenn.; Bruce Handrinos, Washington, Mich.; Michael Garascia, Warren, Mich.; Marko Djekovic, Shelby Township, Mich.; Donald Gatson, Ypsilanti, Mich.

[73] Assignee: Dura Automotive Systems, Inc., Rochester Hills, Mich.

[21] Appl. No.: 09/133,011

[22] Filed: Aug. 12, 1998

[51] Int. Cl.[7] ..... E05C 17/32

[52] U.S. Cl. ..... 292/263; 292/DIG. 6; 292/DIG. 60

[58] Field of Search ..... 292/113, 247, 292/263, DIG. 6, DIG. 39, DIG. 40, DIG. 53, DIG. 60; 248/475.1, 298.1, 203.3, 467, 477, 274.1, 205.1

[56] References Cited

U.S. PATENT DOCUMENTS

| | | | |
|---|---|---|---|
| 2,059,858 | 11/1936 | Erust | 248/223 |
| 2,486,772 | 11/1949 | Wuerl | 292/341.18 |
| 4,120,524 | 10/1978 | Buck | 292/263 |
| 4,206,939 | 6/1980 | Rowley, II | 292/263 |
| 4,288,120 | 9/1981 | Moore | 292/341.18 |
| 4,469,370 | 9/1984 | Petersen | 296/218 |
| 4,470,624 | 9/1984 | Bisbing | 292/169 |
| 4,482,176 | 11/1984 | Rider, Jr. et al. | 292/87 |
| 4,522,436 | 6/1985 | Hoen | 292/113 |
| 4,534,587 | 8/1985 | Fleming | 292/263 |
| 4,556,244 | 12/1985 | Bisbing | 292/65 |
| 4,571,888 | 2/1986 | Jensen | 49/450 |
| 4,583,775 | 4/1986 | Bisbing | 292/64 |
| 4,586,736 | 5/1986 | Dougherty | 292/202 |
| 4,668,059 | 5/1987 | Ohyama | 350/632 |
| 4,687,237 | 8/1987 | Bisbing | 292/78 |
| 4,693,187 | 9/1987 | Bisbing | 108/69 |
| 4,804,215 | 2/1989 | Bisbing | 292/113 |
| 4,828,298 | 5/1989 | Bisbing | 292/113 |

(List continued on next page.)

FOREIGN PATENT DOCUMENTS

| | | | |
|---|---|---|---|
| 1 015 997 | 1/1966 | United Kingdom | 292/DIG. 6 |

OTHER PUBLICATIONS

Adjustable Non–corrosive Draw Latch, Southco Latches and Access Hardware, North American Edition—48 NA, ISO 9001, Quality System, Southco, Inc.

*Primary Examiner*—B. Dayoan
*Assistant Examiner*—Gary Estremsky
*Attorney, Agent, or Firm*—Banner & Witcoff, Ltd.

[57] ABSTRACT

A latch assembly for a windowpane of a motor vehicle window is disclosed. The latch assembly has a latch anchor attachable to the motor vehicle, a latch base and a lever or linking mechanism connecting the latch anchor to the latch base. The latch base has an upper base attached to the linking mechanism and a lower base attached to the windowpane. The lower base may be secured to the windowpane either by an adhesive or by partial encapsulation with a polyurethane material which bonds to the windowpane. The upper base is adjustable with respect to the lower base along a first axis to accommodate sheet metal variations, tolerance errors and other misalignments. At least one elongate riser extending from the lower base is received by a corresponding elongate opening of the upper base to form an interlock between the upper base and the lower base resisting separation along second and third axes, which are perpendicular to the first axis and to each other. The elongate riser may optionally have a tenon cross section and the elongate opening on the upper base may have a mortise cross section so that the interlock is a slidable dovetail interlock.

19 Claims, 4 Drawing Sheets

U.S. PATENT DOCUMENTS

| | | | |
|---|---|---|---|
| 4,830,413 | 5/1989 | Bisbing | 292/247 |
| 4,867,494 | 9/1989 | Castiglioni | 292/263 |
| 4,890,869 | 1/1990 | Langkamp, Jr. | 292/113 |
| 5,158,329 | 10/1992 | Schlack | 292/87 |
| 5,165,738 | 11/1992 | McCormack | 292/67 |
| 5,271,649 | 12/1993 | Gromotka | 292/113 |
| 5,368,347 | 11/1994 | Holtman et al. | 292/257 |
| 5,409,272 | 4/1995 | McCormack | 292/66 |
| 5,439,305 | 8/1995 | Santo | 403/76 |
| 5,452,926 | 9/1995 | Takimoto | 292/113 |
| 5,478,125 | 12/1995 | Gromotka | 292/67 |
| 5,521,760 | 5/1996 | De Young | 359/601 |
| 5,551,197 | 9/1996 | Repp et al. | 52/204.62 |
| 5,584,516 | 12/1996 | Cetnar | 292/336.3 |
| 5,587,236 | 12/1996 | Agrawal | 428/334 |
| 5,590,921 | 1/1997 | Holtman et al. | 292/257 |
| 5,603,535 | 2/1997 | Antonucci et al. | 292/128 |
| 5,607,195 | 3/1997 | Antonucci | 292/247 |
| 5,609,373 | 3/1997 | Gromotka | 292/229 |
| 5,657,969 | 8/1997 | Bivens | 267/64.12 |
| 5,664,813 | 9/1997 | Gromotka | 292/229 |

ADJUSTABLE LATCH FOR WINDOW ASSEMBLY

FIELD OF THE INVENTION

The present invention generally relates to an improved latch, and more particularly to an adjustable latch useful on window assemblies.

BACKGROUND OF THE INVENTION

Windows used in motor vehicles often have a latch assembly securing a windowpane to the motor vehicle. Flip windows are used, for example, as side windows on minivans. Known latch assemblies, particularly those used for flip windows in motor vehicles, allow the windowpane to pivot out or up to a fixed distance. This allows a given amount of air into the motor vehicle without having the windowpane extend too far from the exterior sheet metal of the motor vehicle. The latch assembly for the flip window often has a latch base attached near one edge of the windowpane, connected to a latch anchor which is in turn attached to the motor vehicle. Operation of the latch assembly allows the windowpane to pivot away from the motor vehicle on a hinge attached near a second edge of the windowpane opposite the latch base. Such latch assemblies typically have pivotable links connecting the latch anchor to the latch base. The links pivot to a fully extended position as the windowpane pivots from a closed position to a full open position.

In recent years it has become desirable to use increasingly large windowpanes on motor vehicles to enhance aesthetics and visibility. It has also become desirable to mount the windowpane essentially flush with an exterior surface of the motor vehicle. However, errors in the sheet metal of the motor vehicle surrounding the opening receiving the windowpane and tolerance variations in the windowpane itself may position the windowpane is an aesthetically unappealing non-flush or otherwise somewhat misaligned position. That is, the windowpane, while functional, may be aesthetically unattractive as the windowpane can be slightly misaligned with respect to the rest of the motor vehicle. It would be desirable for the assembler of the window assembly to the motor vehicle to be able to adjust the latch assembly to compensate for any such slight misalignment.

In view of the foregoing, it is an object of the present invention to provide a latch assembly for a window assembly which is adjustable to accommodate manufacturing tolerance problems and is of low cost. It is another object of the present invention to provide a latch assembly for an articulating window assembly of a motor vehicle positioned free of an outer surface of the windowpane. It is another object of the present invention to provide a latch assembly for a window assembly which closes an opening in a motor vehicle and is positioned flush with an exterior surface of the motor vehicle. It is yet another related object of the present invention to provide such a latch assembly that is highly reliable in operation.

SUMMARY OF THE INVENTION

In accordance with these and other objects, there is provided a latch assembly comprising a latch base mounted to a windowpane, the latch base being adjustable to account for miscellaneous tolerance errors and misalignments of the windowpane or the sheet metal of a motor vehicle. The latch assembly further comprises a latch anchor adapted for rigid attachment to a panel such as the frame of a motor vehicle, and lever linking components movable between open and closed positions and pivotably mounted on either the latch base or the latch anchor. The latch base has an upper base which is adjustable with respect to a lower base along a first axis. The latch base further comprises connecting elements for resisting separation of the upper base from the lower base along a second and third axis, the second and third axes being perpendicular to the first axis and to each other. The connecting elements preferably comprise at least one elongate riser extending from the lower base along the first axis and having a top and bottom where the top is wider than the bottom, and a corresponding elongate channel in the upper base sized to receive the elongate riser to form an interlock between the upper base and the lower base, thereby resisting separation of the upper base from to the lower base along the second and third axes, and a positioning member such as a screw adjustably fixing the position of the upper base along the first axis with respect to the lower base. The latch base may be attached to a windowpane and the latch anchor may be attached to the wall of a motor vehicle. Advantageously, misalignment of the windowpane may be accommodated during assembly by adjustment of the positioning member, thereby properly aligning the windowpane to produce an aesthetically desirable motor vehicle exterior.

In such preferred embodiments the linking components can comprise a release handle or helmet attached at one end to the upper base, and a link sometimes referred to as a dogbone connecting the helmet to the latch anchor. The release handle and the dogbone may be folded when the latch base is in the closed position, and unfolded when the latch base moves to the open position.

From the foregoing disclosure and the following more detailed description of various preferred embodiments it will be apparent to those skilled in the art that the present invention provides a significant advance in the technology and art of latches for window assemblies. Particularly significant in this regard is the potential the invention affords for providing a high quality latch/window assembly capable of producing an aesthetically desirable appearance when positioned in a window opening in the frame of a motor vehicle. Additional features and advantages of various preferred embodiments will be better understood in view of the detailed description provided below.

Figure 1:
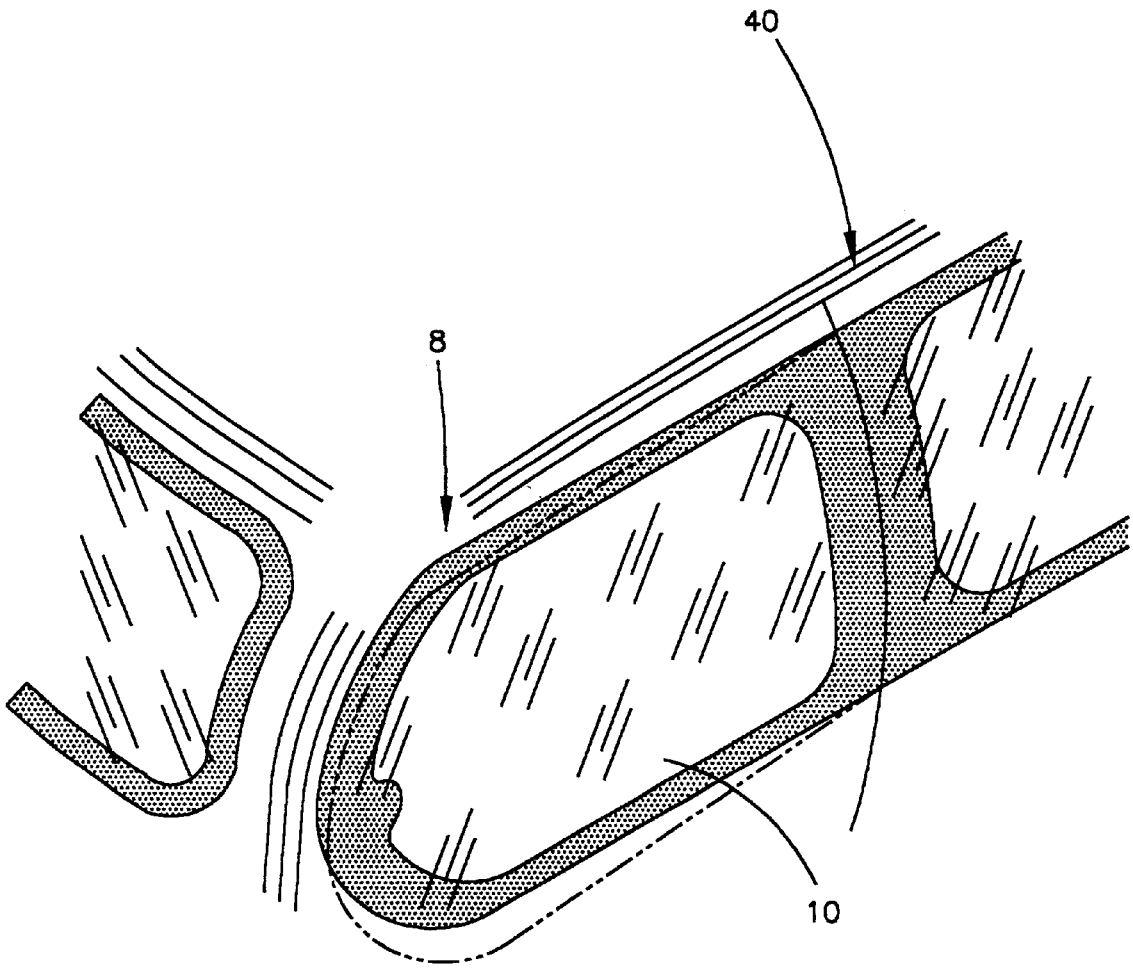
FIG. 1 is a perspective view of a flush-mounted articulated window assembly shown in assembly in a motor vehicle in accordance with a preferred embodiment.

It should be understood that the appended drawings are not necessarily to scale, presenting a somewhat simplified representation of various preferred features illustrative of the basic principles of the invention. The specific design features of an adjustable latch assembly as disclosed here, including, for example, specific dimensions of the dovetail interlock and the latch anchor, will be determined in part by the particular intended application and use environment. Certain features of the illustrated embodiments have been enlarged or distorted relative to others to facilitate visualization and clear understanding. In particular, thin features may be thickened, for example, for clarity of illustration. All references to direction and position, unless otherwise indicated, refer to the orientation of the latch assembly illustrated in the drawings. In general, front or frontward refers to a left direction in the plane of the paper in FIG. 2, rear, rearward or backwards refers to a right direction in the plane of the paper in FIG. 2, and inboard and outboard refer to directions normal to the plane of the paper in FIG. 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved adjustable latch for a window assembly disclosed here. The following detailed discussion of various alternative and preferred features and embodiments will illustrate the general principles of the invention with reference to a flush mounted window assembly for use as a flip window on a minivan or the like. Other embodiments suitable for other applications, such as sliding window assemblies for the back of pickup trucks, will be apparent to those skilled in the art given the benefit of this disclosure.

Figure 2:
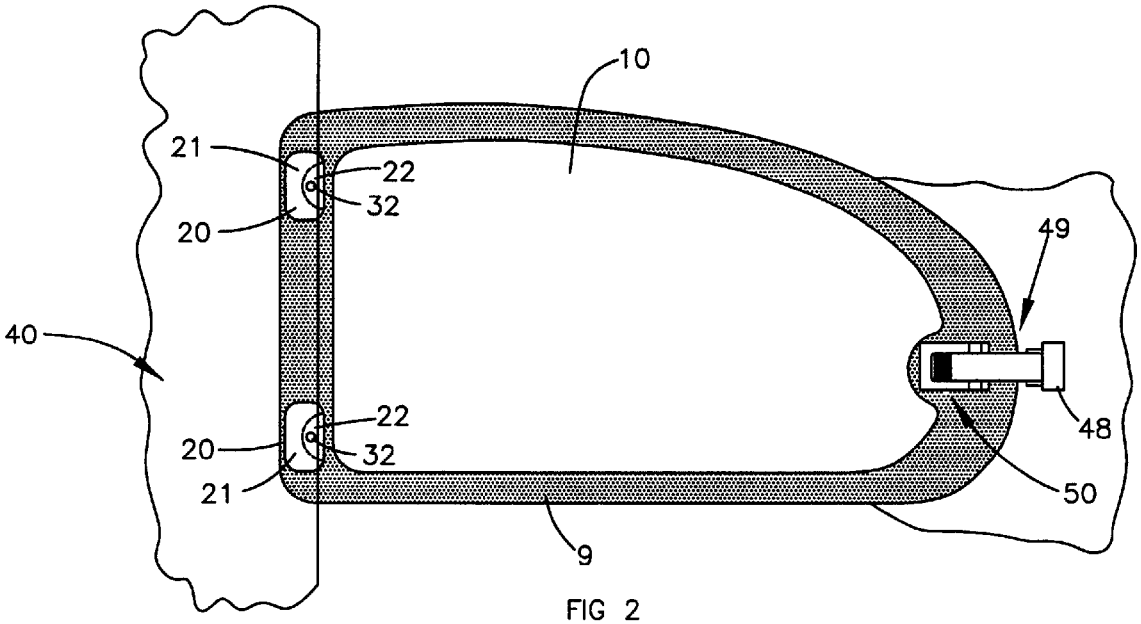
FIG. 2 is a side elevational view of the inner surface of the window assembly of FIG. 1, showing an inner surface of the windowpane.

Referring now to the drawings, FIG. 1 is an external view of a motor vehicle including mounting wall 40 having an articulating window assembly 8 including windowpane 10. In this embodiment, as seen in FIG. 2, the windowpane 10 is mounted to motor vehicle mounting wall 40 by a hinge or hinges 20 at one end or peripheral portion of the windowpane and at an opposite end or peripheral portion by a latch assembly 13 comprising a latch anchor 48 attached to the mounting wall 40, and a latch base 50 attached to the windowpane, connected by linking components 49. The hinges 20 may be, for example, formed of reaction injection molded polyurethane each having a portion 21 bonded to the windowpane and a portion 22 not bonded to the windowpane to enhance flexibility. Preferably each unbonded portion 21 of the hinge 20 is positioned near a mounting stud 32. Mounting stud 32 typically extends into mounting wall 40. Alternatively, a metal bracket glued to the windowpane may be used as the hinge in a manner well known to those skilled in the art.

In accordance with an advantageous feature, both the hinges 20 and the latch assembly 13 may be flush mounted on the windowpane 10, thereby permitting the windowpane to be aligned with an exterior surface 41 of the motor vehicle 40 in an aesthetically appealing manner. That is, the hinges 20 and the latch assembly may be mounted on the interior surface 12 of the windowpane 10, free of the outer surface 11 of the windowpane, advantageously eliminating the need for holes through the windowpane and so-called "beauty buttons" covering such holes through the windowpane. Preferably the hinges and the latch assembly components are hidden from external view by frit or frit like material 9 applied to interior surface 12 of the windowpane.

Figure 3:
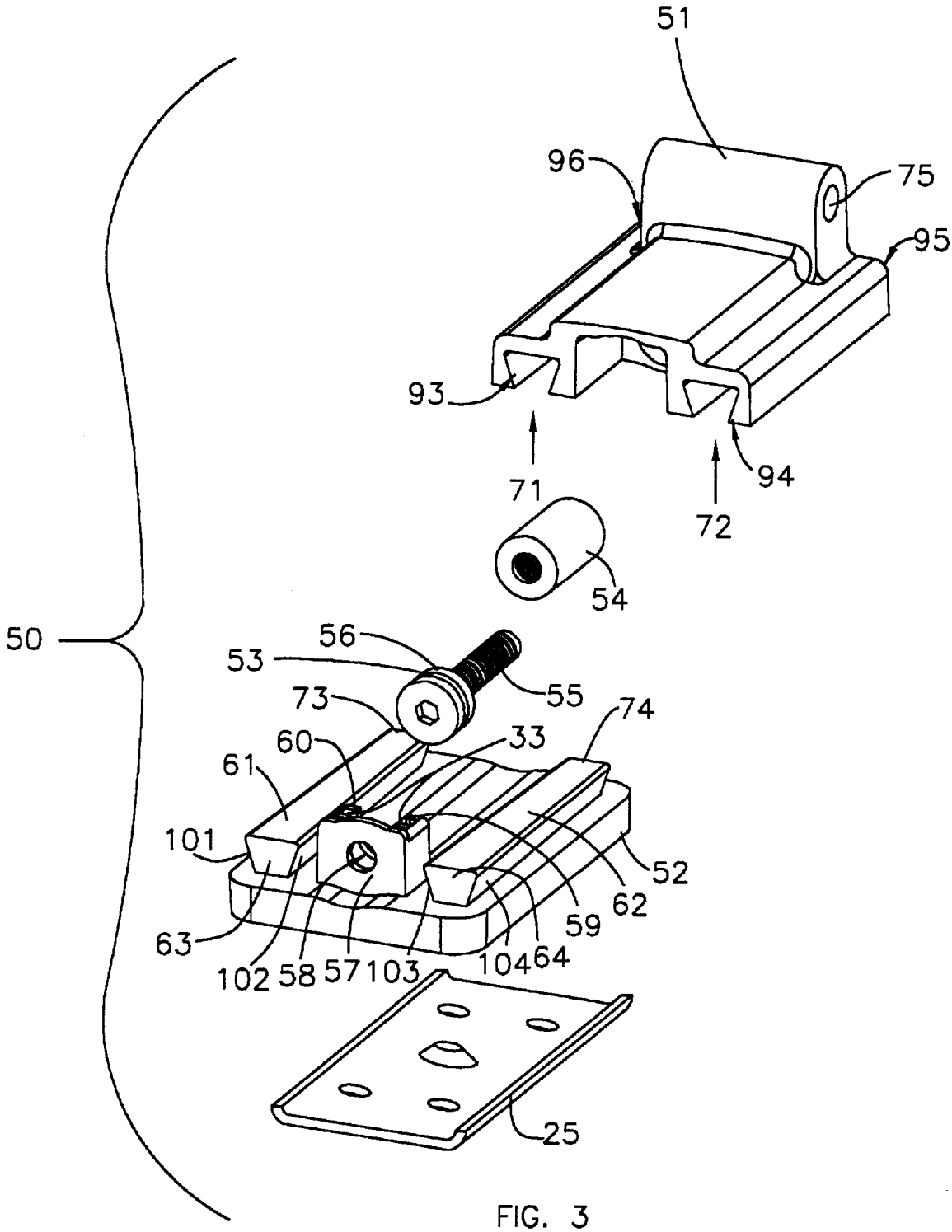
FIG. 3 is an exploded perspective view of the adjustable latch base.

FIG. 3 shows an exploded perspective view of a preferred embodiment of latch base 50 having upper base 51 and lower base 52. In accordance with a highly advantageous feature of the invention, the latch base 50 is adjustable to allow for miscellaneous variations and tolerance errors in the window assembly or in the sheet metal of the motor vehicle, thereby enhancing the exterior styling and aesthetics of the window assembly and providing complete closure of the window assembly. Lower base 52 is affixed to the windowpane 10 and therefore is movable with the windowpane 10 as windowpane 10 moves between full open and closed positions. Lower base 52 may be formed of an injection molded plastic. In the embodiment shown in the drawings, an electrocoated metal plate 25 is insert molded to the lower base. Metal plate 25 provides an excellent bonding surface for an adhesive (not shown) to secure the lower base to the windowpane 10. Other suitable means for securing the lower base to the windowpane, such as encapsulating part of the lower base with RIM polyurethane secured to the windowpane, will be readily apparent to those skilled in the art given the benefit of this disclosure.

Figure 4:
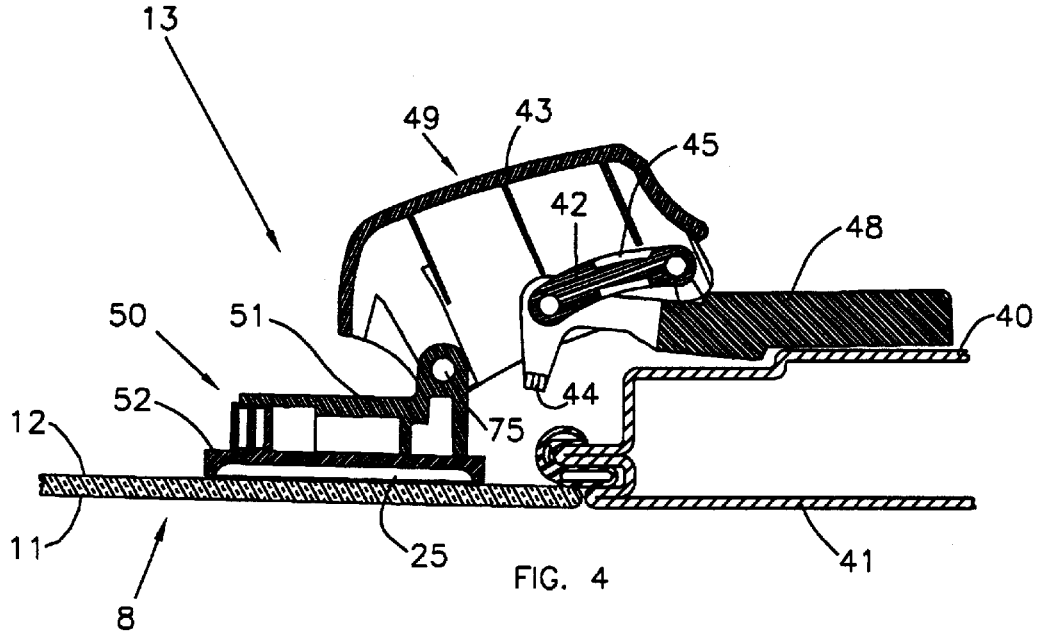
FIG. 4 is a side view of the latch assembly shown when the windowpane is in the closed position.
Figure 5:
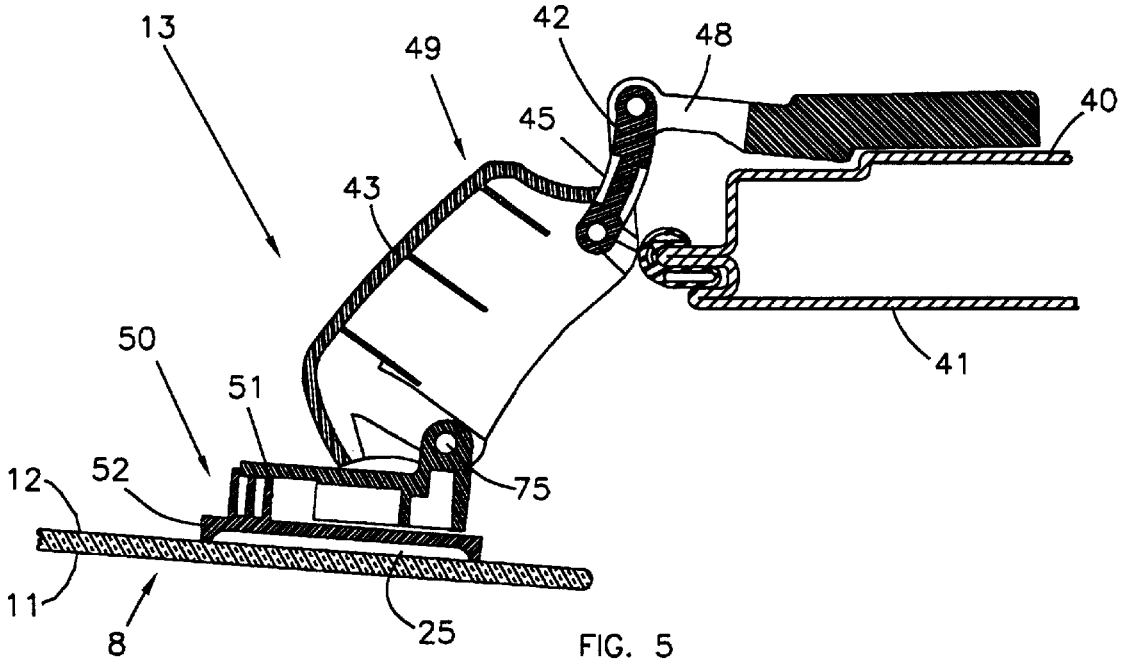
FIG. 5 is a side view of the latch assembly shown when the windowpane is in the full open position.

Lower base 52 cooperates with upper base 51 to secure the windowpane 10 to the linking components 49 shown in FIGS. 4 and 5. Lower base 52 has male dovetails or elongate risers 61, 62 which are slidably received in corresponding female dovetails or openings 71 and 72 in the upper base 51. As shown in FIG. 3, preferably the risers 61, 62 are tapered along their length, so that one end 63, 64 of each riser, 61,62, respectively, is wider than the corresponding opposite ends 73, 74. Similarly, female dovetails 71, 72 have openings 93, 94, respectively, which are wider than openings 95, 96 at the other end. In this way the upper base 51 may be slid onto the lower base 52 in only one direction, and continued sliding of the upper base over the lower base will result in the male dovetails wedging against the female dovetails, restricting further movement of the upper base in that direction.

Preferably the dovetails 61, 62, of the lower base 52 have a tenon cross section and the upper base dovetails 71, 72 have a mortise cross section, forming an interlock to resist inboard-outboard and up-down separation of the upper base from the lower base. That is, male risers 61, 62 each have side walls 101, 102 and 103, 104 extending away from one another so that top of the dovetail is wider than its bottom. The shape of the female dovetail corresponds to the male dovetail to form a slidable dovetail interlock. The male dovetails 61, 62 cooperate with the female dovetails 71, 72 to restrict separation of the upper base from the lower base along two axes, but the upper base can be separated from the lower base along a third axis perpendicular to the first two axes, in the lengthwise direction of the dovetails. Cooperating with the dovetail interlock to complete the connection of the upper base to the lower base is an adjustment member such as a screw 55 in a threaded bore 54. The screw and threaded bore adjustably secure the upper base 51 with the lower base 52, that is, as a single piece with the lower base. Preferably the threaded bore 54 is insert molded into the upper base 51, and the head 56 of the screw is seated in a screw head pocket projection 57 formed as a unitary extension of the lower base 52. The screw head pocket projection 57 may optionally be provided with side walls 59, 60 which extend into slot 53 in the screw head 56 and serve to additionally captivate screw head 56.

Pocket projection 57 has opening 58 so that a screwdriver can access screw head 56 to rotate the screw in either clockwise or counterclockwise directions. Rotation of the screw 55 allows for adjustment of the position of lower base 52 with respect to the upper base 51, and therefore adjustment of the windowpane 10 with respect to the upper base.

FIG. 4 shows the latch assembly 13 connecting the mounting wall 40 to the windowpane 10 wherein the windowpane is in a closed position so that the exterior surface 11 of the windowpane is aligned generally flush with an exterior surface 41 of the motor vehicle. If, upon assembly, an operator finds that the windowpane is somewhat misaligned with the exterior surface 41 of the motor vehicle, a screwdriver may be inserted through opening 58 of pocket projection 57 to screw 55 for adjustment of the upper base with respect to the lower base. More specifically, adjustment of the upper base 51 with respect to the lower base 52 by screw 55 will effect flushness adjustment by moving the windowpane inboard or outboard.

FIG. 5 shows the latch assembly moved to an open position. This may be accomplished by rotation of helmet 43, which is part of the linking components 49 connecting the upper base 51 to the mounting wall 40. The helmet 43 is pivotably mounted near one end to the upper base 51 at opening 75 and near its other end to link or dogbone 42. Dogbone 42 is a generally linear member pivotably connected at one end to helmet 43 and pivotably attached at its other end to the latch anchor 48. Dogbone 42 and helmet 43 unfold as the windowpane moves from the closed position to the open position. In a highly advantageous feature of the embodiment shown in FIGS. 4 and 5, latch anchor 48 is provided with flanges 44 which snap fit past flexible flanges 45 which extend in a direction transverse to the length of the dogbone, to produce a positive snap fit feeling when the windowpane pivots to the full open position. As helmet 43 and dogbone 42 are each pivotably mounted at both ends, adjustment of screw 55 allows for some radial adjustment of the windowpane along the direction the windowpane pivots, and not merely along an axis parallel to the dovetails 61, 62. Preferably when the helmet is in the closed position it covers the link 42 so that the link is largely hidden from interior view.

From the foregoing disclosure and detailed description of certain preferred embodiments, it will be apparent that various modifications, additions and other alternative embodiments are possible without departing from the true scope and spirit of the invention. For example, the adjustable latch base could be used on a dual pane sliding window assembly, where two panes are slidable back and forth and meet each other in a closed position. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A latch assembly comprising, in combination:

a latch anchor adapted for rigid attachment to a panel;

an adjustable latch base movable relative to the latch anchor between a closed position and a full open position; and lever means pivotably interconnecting the latch base and the latch anchor;

wherein the latch base comprises:

a lower base adapted for attachment to a second panel, an upper base adjustable with respect to the lower base along a first axis, connection means for resisting separation of the upper base from the lower base along a second axis and a third axis, the second and third axes each being perpendicular to the first axis and to each other, the connection means comprising an elongate riser extending from the lower base along the first axis and having a bottom and a top where the top is wider than the bottom, and an elongate opening in the upper base sized to receive the elongate riser and form an interlock between the upper base and the lower base, thereby resisting separation of the upper base with respect to the lower base along the second and third axes, and a positioning member adjustably fixing the position of the upper base along the first axis with respect to the lower base.

2. The latch assembly of claim 1 wherein the elongate riser has a tenon cross section and the elongate opening on the upper base has a mortise cross section, and the interlock is a slidable dovetail interlock.

3. The latch assembly of claim 1 wherein the elongate riser is tapered along the first axis, and the opening is correspondingly tapered along the first axis.

4. The latch assembly of claim 1 wherein the positioning member secures the upper base to the lower base.

5. A latch assembly comprising, in combination:

an adjustable latch base;

a latch anchor adapted for rigid attachment to a panel, the latch anchor connected to the latch base by a pivotable helmet and pivotable link;

lever means pivotally secured at one end to the latch base and at another end to the latch anchor, the lever means being folded when the latch base is in a closed position and unfolded when the latch base is in a full open position, thereby restricting a range of travel of the latch base relative to the latch anchor;

wherein the latch base comprises a lower base adapted for rigid attachment to a second panel, an upper base attached to the lever means and mounted to the lower base in an adjustably fixed position, and positioning means for positioning the upper base in the adjustably fixed position relative to the lower base; and the upper base is slidably adjustable over the lower base along a first axis, and the positioning means comprises a threaded bore affixed to one of the upper base and the lower base, and a screw having a threaded portion received into the bore and a head, wherein the head of the screw is constrained by the other of the upper base and the lower base so that rotation of the screw urges the upper base to slide with respect to the lower base along the first axis, and urges the helmet to move alone both the first axis and a second axis perpendicular to the first axis.

6. The latch assembly of claim 5 wherein the threaded bore is positioned in the upper base and the screw head is seated in a capture pocket defined by a projection extending from the lower base, restricting movement of the screw with respect to the lower base along the first axis.

7. The latch assembly of claim 5 wherein the upper base and the lower base comprise an injection molded plastic and the threaded bore is insert molded into the upper base.

8. The latch assembly of claim 5 wherein the latch base further comprises connection means for resisting separation of the upper base from the lower base along the second axis and a third axis, the second and third axes each being perpendicular to the first axis and to each other.

9. The latch assembly of claim 8 wherein the connection means comprises an elongate riser extending from the lower base along the first axis and having a top and a bottom where the top is wider than the bottom, and an elongate opening in the upper base sized to receive the elongate riser and form an interlock between the upper base and the lower base, thereby resisting separation of the upper base with respect to the lower base along the second and third axes.

10. The latch assembly of claim 5 wherein the lever means comprises a handle pivotably attached to the upper base, and a link pivotably attached to both the handle and the latch anchor.

11. A latch assembly for a motor vehicle comprising, in combination:

a windowpane having an inner surface and an outer surface and pivotable from a closed position to a full open position on a hinge mounted at a first peripheral portion of the windowpane;

a latch mounted at a second peripheral portion of the windowpane, opposite the first peripheral portion, releasably securing the windowpane in a closed position to the motor vehicle, the latch comprising:

an adjustable latch base comprising a lower base affixed to the windowpane, an upper base positioned over the lower base, and positioning means for positioning the upper base in an adjustably fixed position along a first axis with respect to the lower base;

a latch anchor rigidly attached to the motor vehicle;

lever means for connecting the latch base to the latch anchor; and connection means for resisting separation of the upper base from the lower base comprising an elongate riser extending from the lower base and having a top and a bottom where the top is under than the bottom, and an elongate opening in the upper base sized to receive the elongate riser and form an interlock between the upper base and the lower base, thereby resisting separation of the upper base with respect to the lower base.

12. The latch assembly of claim 11 wherein the positioning means comprises a threaded bore affixed to one of the upper base and the lower base, and a screw having a threaded portion received into the bore and a head, wherein the head is constrained by the other of the upper base and the lower base so that rotation of the screw urges the upper base to slide with respect to the lower base along the first axis.

13. The latch assembly of claim 11 wherein the latch base and the hinge are positioned free of the outer surface of the windowpane.

14. The latch assembly of claim 11 wherein the outer surface of the windowpane is positioned substantially flush with an outer surface of a motor vehicle.

15. The latch assembly of claim 11 wherein the lower base comprises an injection molded plastic, a metal bracket is insert molded into the plastic and the metal bracket is adhesively bonded to the windowpane.

16. The latch assembly of claim 11 wherein the lever means comprises a handle pivotably mounted on the upper base and a link pivotably mounted on both the handle and the latch anchor, connecting the latch anchor to the handle.

17. The latch assembly of claim 16 wherein the link has a pair of flexible flanges which snap past corresponding latch anchor flanges to releasably hold the windowpane in the full open position.

18. The latch assembly of claim 11 wherein the connection means resists separation of the upper base from the lower base along a second axis and a third axis, the second and third axes each being perpendicular to the first axis and each other, wherein the elongate riser is talon-shaped and extends along the first axis from the lower base, and the elongate opening is mortise-shaped and sized to receive the elongate riser and form a dovetail interlock between the upper base and the lower base, thereby resisting separation of the upper base with respect to the lower base along the second and third axes.

19. The latch assembly of claim 11 wherein the latch base is a plate-like member and adjustment of the upper base moves the upper base toward or away from the latch anchor.

* * * * *